United States Patent [19]

Noguchi

[11] 4,366,579

[45] Jan. 4, 1983

[54] MITT FOR BASEBALL USE

[75] Inventor: Teruo Noguchi, Osaka, Japan

[73] Assignee: Mutsuwa Taiga Kabushiki Kaisha, Osaka, Japan

[21] Appl. No.: 239,481

[22] Filed: Mar. 2, 1981

[30] Foreign Application Priority Data

Apr. 25, 1980 [JP] Japan ..... 55-55911

[51] Int. Cl.[3] ..... A41D 13/10

[52] U.S. Cl. ..... 2/19; 2/169

[58] Field of Search ..... 2/19, 161 R, 161 A, 2/16, 20, 169

[56] References Cited

U.S. PATENT DOCUMENTS

| | | | |
|---|---|---|---|
| 808,980 | 1/1906 | Gamble | 2/19 |
| 1,083,795 | 1/1914 | Brokaw | 2/19 X |
| 1,974,616 | 9/1934 | Kirkham | 2/19 |
| 2,288,467 | 6/1942 | Latina | 2/19 |
| 2,662,225 | 12/1953 | Wheeler | 2/19 |

*Primary Examiner*—Richard J. Scanlan, Jr.

*Attorney, Agent, or Firm*—Wenderoth, Lind & Ponack

[57] ABSTRACT

The invention provides a mitt for baseball use. Vegetable oil, such as castor oil or the like, is permeated under a heating operation into the ball-catching portion of the leather on the ball-catching side. A polyurethane resin layer is provided on the reverse face of the vegetable oil permeated portion of said leather, said polyurethane resin layer being formed through the application of the polyurethane resin immediately after a second heating operation of the leather and after said heating operation has been completed.

2 Claims, 4 Drawing Figures

MITT FOR BASEBALL USE

The present invention relates to a mitt for baseball use, which is adapted to simplify the catching action of a ball and is improved in strength.

The mitt for use in the baseball, which is made of cow leather or the like, is relatively hard to bend when it is new, thus rendering it difficult for the player to catch the ball. Thus, vegetable oil is applied upon the catching portion of the mitt and the other required portions thereof to soften the leather. If the mitt becomes softened through application of the oil, the mitt is easier to bend so that the catching action of the ball may be simplified. On the other hand, the fibers of the leather are more easily stretched and put out of shape, thus failing to catch the ball. In addition, the service life of the mitt is shortened. Methods of reducing the deformation of the leather fibers are known to prevent the mitt from getting out of shape. However, in this case, the problem of the ball-catching action remains, since the flexibility of the leather is deteriorated.

The present invention is provided to solve such a problem as described hereinabove. The embodiment of the present invention will be described hereinafter with reference to the drawings.

The drawings show the embodiment of the present invention.

Figure 1:
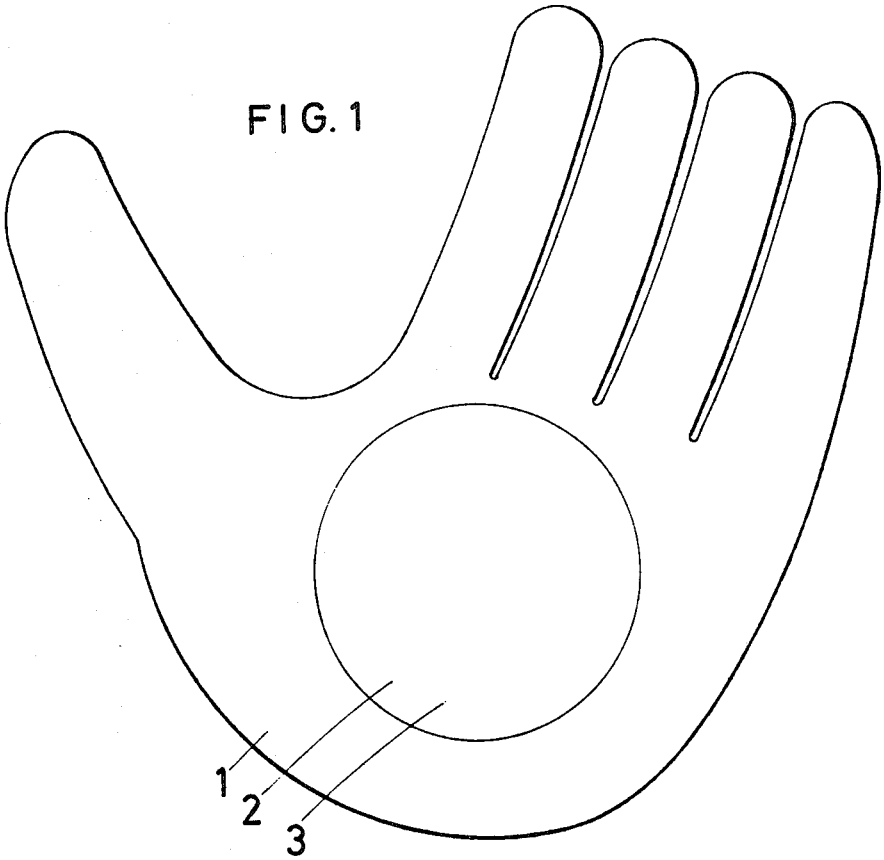
FIG. 1 shows the reverse face of the leather on the ball-catching side.
Figure 3:
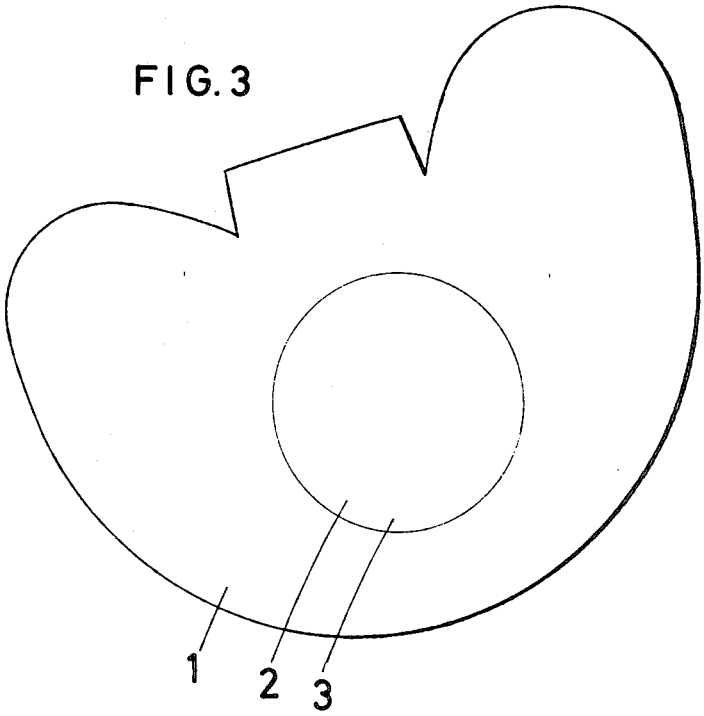
FIG. 3 is a rear face view of the leather on the ball-catching side in another embodiment.
Figure 2:
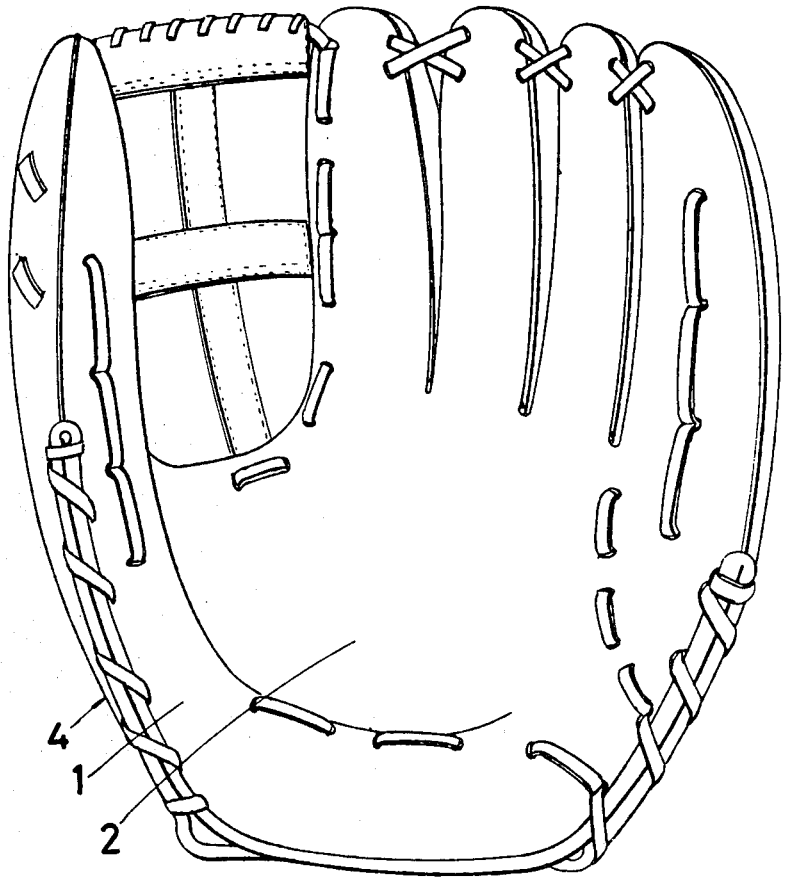
FIG. 2 shows the front face view of a mitt.
Figure 4:
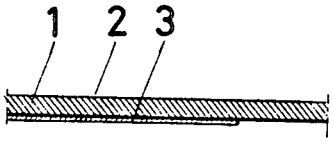
FIG. 4 is an enlarged cross-sectional view of an essential portion.

1 is a punched leather on the catching side of the mitt. FIG. 1 and FIG. 3 show different mitts for fielding position use, respectively. The shapes of the mitt can be optionally selected. A vegetable oil such as castor oil for softening the leather is applied upon the whole reverse face of the ball-catching portion 2 of the leather 1, which is repeatedly used to catch the ball. The vegetable oil is permeated into the leather 1 by heating in a heated metallic mold. The temperature and time which can achieve the object are required to be selected for the heating operation, since the heating operation is effected to permeate the coated vegetable oil into the leather 1. The object can be achieved through a heating operation of approximately 20 to 60 seconds at the temperature of approximately 60° to 100° C. As the metallic mold for use in the heating operation, a pair of metallic molds or a pair of molds, one thereof being made of metal and the other being made of rubber. The leather 1 is grasped and heated between the pair of molds during the heating operation. No particular pressures are required. The pressure of such as approximately 1 to 3 Kg, i.e., a light connection between the pair of molds, is required.

The leather, which has completed a first heating operation, is softened due to the permeated oil. The vegetable-oil-permeated leather is heated again by a pair of molds similar to those used for the first heating operation. During the second heating operation, the mitt is heated without any oil application at a temperature of approximately 100° to 170° C. for approximately 30 to 120 seconds. Even during the second heating operation, no particular pressures are required. Pressures of approximately 2 to 5 Kg will do. Immediately after the second heating operation, polyurethane resin is coated and hardened on the vegetable-oil-coated portion of the reverse face of the leather 1 thereby to form a polyurethane resin layer 3. The second heating operation heats the oil-permeated leather 1 to simplify the application of the polyurethane resin and dries the reverse face of the leather 1 thereby to improve the adhesion of the polyurethane resin. And the above-described temperature and time show one example suitable for achieving the above-described objects. So long as the above-described objects can be achieved, the temperature can be rendered higher or lower in a range where no influences are applied upon the leather. Also, the time can be rendered shorter or longer in accordance with the temperature.

Since the leather 1 is heated during the application of the polyurethane resin, the polyurethane resin can be unevenly and easily applied. And since the reverse face of the leather 1 is rough and the surface portion is in a dry condition through the second heating operation, the polyurethane resin can be easily and firmly adhered. The first and second heating operations may be continuously effected. However, the second heating operation after the cooling operation of the leather 1 at an interval of approximately 3 to 15 minutes is proper for the drying operation of the reverse face. The leather 1 treated as described hereinabove serves to provide a mitt. 4 is a mitt using a leather 1 of FIG. 1.

The leather 1 is easier to bend during the ball catching action, since the mitt of the present invention has the catching-side leather 1 coated and impregnated with the leather softening vegetable-oil such as castor oil or the like so that the mitt is provided with flexibility. And, the polyurethane resin which is superior in characteristics against pull and tear-off is formd on the reverse face of the leather 1 to reinforce the softened leather 1 with the strength of the resin. Namely, the flexibility is provided by the vegetable oil. Stretching of the treated portion of the leather 1 which has now become easier to stretch, and the deformation accompaned due to the stretching operation are prevented by the use of the polyurethane resin layer 3 attached on the reverse face. Accordingly, the catching portion 2 of the leather 1 hardly stretches due to the pressures of the ball during the ball-catching action. Even if the ball-catching portion stretches, the stretch is smaller. The damage to and deformation of the ball-catching portion 2, which are caused due to the stretching of the leather, are prevented if the ball-catching action is repeated. Longer service life is ensured. In addition, the leather 1 is provided with a condition easier for catching the ball through the entire service life.

Since the polyurethane resin layer 3 is formed only on the reverse face of the leather 1 and is thin enough to be easily bent, the flexibility of the leather 1 provided through the vegetable oil treatment is not deteriorated. During the ball-catching action, the leather 1 is easily bent to simplify the ball catching action and to prevent the mitt from becoming out of shape. Thus, failure to catch a ball due to the deformation is prevented. The polyurethane resin can be firmly attached, since the vegetable oil is heated and is permeated into the leather 1, the leather is heated again, and the polyurethane resin is adhered on the dried reverse face.

What is claimed is:

1. In a mitt for baseball use comprising a leather ball-catching portion, the improvement wherein the leather which forms the ball-catching portion is permeated with a vegetable oil and bears on the face opposite the ball-contacting face a hardened coating of a polyurethane resin.

2. In a method for making a mitt for baseball use, the improvement wherein (a) the leather forming the catching face of the mitt is treated in the ball-catching portion thereof with vegetable oil in the presence of heat to permeate the vegetable oil into the said ball-catching portion, (b) the vegetable oil-permeated leather is heated to a temperature of approximately 100° to 170° C. and (c) immediately following the heating in step (b) there is applied to the face of the leather opposite the ball-contacting face and over the ball-catching portion a coating of a polyurethane resin.

* * * * *

UNITED STATES PATENT AND TRADEMARK OFFICE

CERTIFICATE OF CORRECTION

PATENT NO. : U. S. Patent No. 4,366,579

DATED : January 4, 1983

INVENTOR(S) : TERAO NOGUCHI

It is certified that error appears in the above-identified patent and that said Letters Patent are hereby corrected as shown below:

On the cover page of the patent, the left hand column, change "[73] Assignee: Mutsuwa Taiga Kabushiki Kaisha" to read --[73] Assignee: Mitsuwa Taiga Kabushiki Kaisha--

Signed and Sealed this

*Eleventh* Day of *October 1983*

[SEAL]

*Attest:*

GERALD J. MOSSINGHOFF

*Attesting Officer*

*Commissioner of Patents and Trademarks*